US006105935A

United States Patent [19]

Wagner

[11] Patent Number: 6,105,935

[45] Date of Patent: Aug. 22, 2000

[54] NAIL REMOVAL TOOL

[76] Inventor: Jefferson Louis Wagner, 1916 Second Dr., Charleston, S.C. 29407

[21] Appl. No.: 09/274,714

[22] Filed: Mar. 22, 1999

[51] Int. Cl.[7] ..... B25C 11/00

[52] U.S. Cl. ..... 254/21; 254/22; 254/23

[58] Field of Search ..... 254/21, 22, 23, 254/30, 132; 269/6

[56] References Cited

U.S. PATENT DOCUMENTS

| | | |
|---|---|---|
| 82,568 | 9/1868 | Tyzick . |
| 222,295 | 10/1879 | McKeever . |
| 724,523 | 4/1903 | Threlkeld . |
| 725,902 | 4/1903 | Welsh . |
| 832,387 | 10/1906 | Jensen . |
| 943,322 | 12/1909 | Soles . |
| 990,926 | 5/1911 | Swainson . |
| 2,870,988 | 1/1959 | Vazquez . |
| 4,007,913 | 2/1977 | Aldrich . |
| 4,084,457 | 4/1978 | Berg . |
| 4,097,021 | 6/1978 | Loboda . |
| 4,776,568 | 10/1988 | Perel . |
| 4,798,366 | 1/1989 | Pearson et al. . |
| 4,815,707 | 3/1989 | Brown . |
| 4,856,759 | 8/1989 | Ness ..... 254/132 |
| 4,997,163 | 3/1991 | Henning . |
| 5,749,113 | 5/1998 | Witter . |
| 5,799,381 | 9/1998 | Gannon et al. . |

*Primary Examiner*—Robert C. Watson
*Attorney, Agent, or Firm*—Harleston Law Firm; Kathleen M. Harleston

[57] ABSTRACT

A nail removal tool for pulling an elongated object that is embedded in a body having a surface through the surface is provided. The nail removal tool comprises: a) an elongated shaft portion having a handle portion at an upper end and a pivot mechanism at a lower end of the shaft portion; b) a movable head portion moveably connected through the pivot mechanism to the lower end of the shaft portion, the head portion comprising a first jaw member, which is fixed to the head portion, and a jaw bedway; and c) a second jaw member parallel to the first jaw member and attached to a movable bedway plate, the bedway plate being inserted in the jaw bedway and also being moveably connected to the lower end of the shaft portion; and wherein the tool has a jaws-closed position and an opposite, jaws-open position.

12 Claims, 5 Drawing Sheets

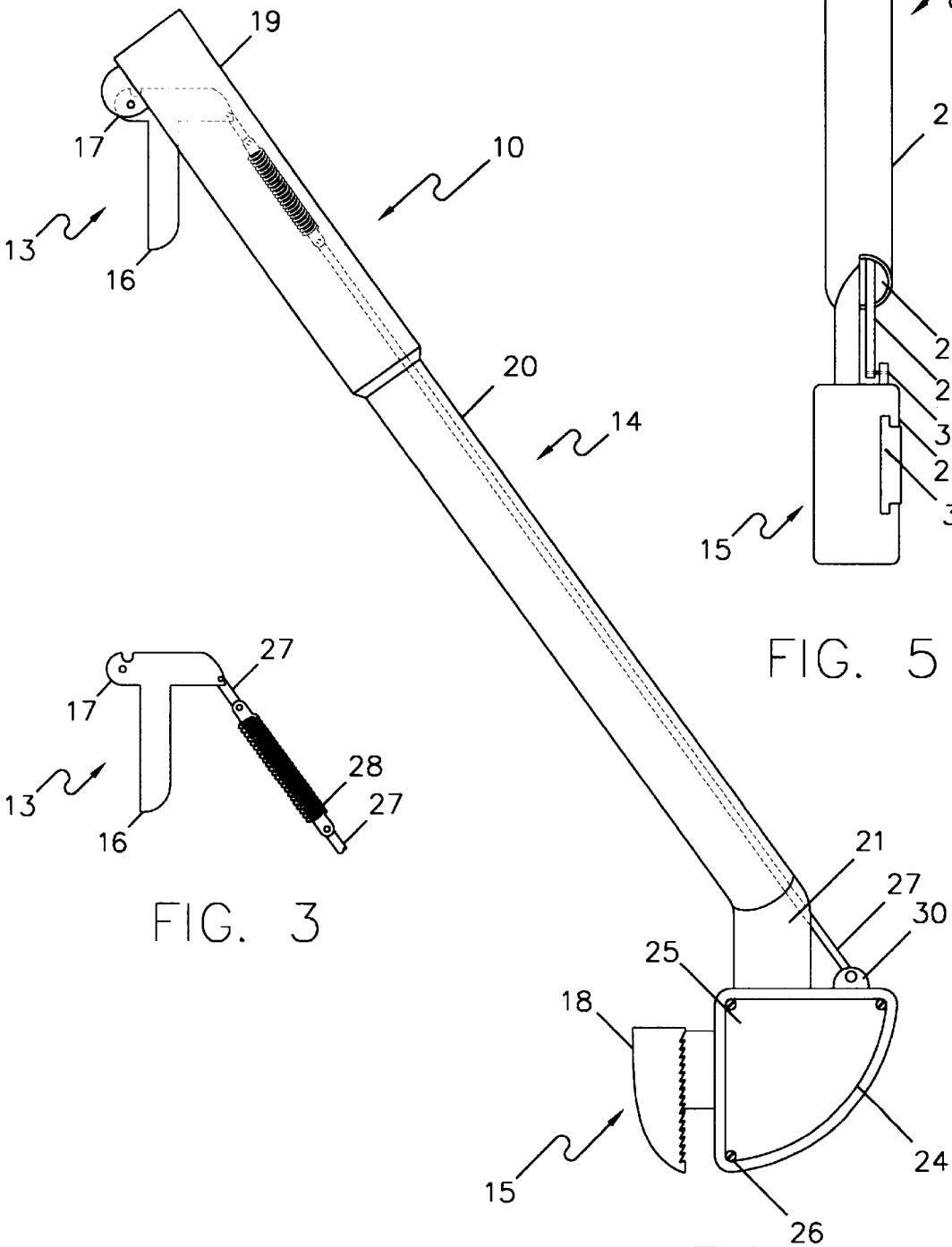
FIG. 4
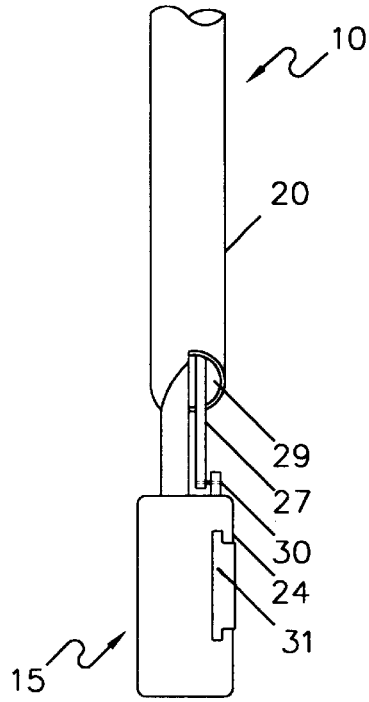
FIG. 5
FIG. 3

NAIL REMOVAL TOOL

CROSS REFERENCE TO RELATED APPLICATIONS

Not Applicable

STATEMENT REGARDING FEDERALLY SPONSORED RESEARCH OR DEVELOPMENT

Not Applicable

REFERENCE TO A MICROFICHE APPENDIX

Not Applicable

BACKGROUND OF THE INVENTION

1. Technical Field

The present invention relates generally to tools, and more particularly to a hand-operated tool for removing an elongated object, especially a finishing nail, that is embedded in a body having a surface through the surface.

2. Background Information

In construction, more labor means higher cost. A small amount of time saved in pulling each spent nail from various surfaces in a building during a remodeling project can mean significant labor savings when the time savings for all of the craftsmen for the duration of the remodeling project are tallied. In short, a better nail removal tool allows talented craftsmen to spend their time on more challenging tasks.

Generally, various tools for helping carpenters and other workers remove spent nails or the like from surfaces are known. There are basically two ways for removing a spent nail from a wooden board: by backing the nail out in the same direction it went in, or by pulling the nail on through the board. The present invention concerns the latter. Regarding the former, the claws of hammers or crowbars or the like can be used for pulling out a nail the way it went in. The claws are placed on either side of a nail head and the worker pulls or levers the hammer to remove the nail from the wood. This is a useful way to pull out traditional, common nails, which have large heads. However, nail heads are often partially or wholly broken off when a molding or other surface is removed during remodeling. There are also many new types of nails being manufactured today. Many of these new types of nails have smooth finishes and are more slender than nails used in previous generations. Pneumatic finishing nails, for example, ordinarily have a very small, thin head. Modern nails also vary widely in length and diameter. They can be difficult to remove without bending or snapping them, or splintering or otherwise damaging the wooden and other surfaces in which they are embedded. Also, in real life, nails do not often present themselves in an erect fashion for removal from boards and other surfaces. A significant percentage of nails to be removed are smashed against the surface, or otherwise bent and/or broken off. In these instances, it is preferable to pull the nail on through the board than to attempt to back the nail out.

Unfortunately, it is difficult to consistently pull a variety of nail types and conditions using currently available tools. Some workers attempt to use pliers or channel locks to pull nails through wooden boards. Typically, available nail pulling tools ("knuckle-busters") do not work effectively on a variety of types and conditions of nails. Available tools often work only on nails which present a substantially straight and significant shaft segment for a nail puller tool to grasp. When a carpenter has to straighten nails in order to use a nail pulling tool, time is wasted. When he or she has to carry several tools for nail removal, and pause to select which tool to use to remove each nail, time is wasted. This is particularly inconvenient when the worker is in an awkward position on a ladder or on a roof or in a crawl space, for example. Incorrect nail removal can result in damage to the wooden surface, such as gouges or holes. In addition, worker frustration and the high physical demands of construction-related jobs are decreased somewhat when nails can be more easily removed.

The tool of the present invention presents a unique advantage in that it can aid in quick, safe, clean removal of a wide variety of nails, especially finishing nails, regardless of the position the nail is in at the time. The worker who carries this tool need not carry or use other tools for pulling nails through a surface. Damage to the surface, such as splintering and gouging, is minimized because nails are more easily and smoothly removed by pulling them through. Crown moldings, baseboards, shelves, paneling, and other surfaces can thus be preserved and reused. The present device does not require much force to use, and preliminary nail straightening is virtually eliminated, so physical demands are less. Worker job frustration is decreased because spent nails can be removed without trouble. The tool of the present invention can grasp and remove short or long, slender or thick nails with smooth or rough finishes. This tool is capable of pulling intact or broken-off nails with broken or small or nonexistent nail heads, so long as some portion of the nail shaft is visible above the surface. The tool is easy to use and is effective in removing quantities of spent nails or other elongated objects. With the preferred trigger mechanism, this tool can also hold the pulled nail until it can be discarded.

BRIEF SUMMARY OF THE INVENTION

The present invention is a nail removal tool for pulling an elongated object that is embedded in a body having a surface through the surface. This nail removal tool comprises:

a) an elongated shaft portion having a handle portion at an upper end and a pivot mechanism at a lower end of the shaft portion;

b) a movable head portion moveably connected through the pivot mechanism to the lower end of the shaft portion, the head portion comprising a first jaw member, which is fixed to the head portion, and a jaw bedway for a second jaw member; and c) a second jaw member parallel to the first jaw member and attached to a movable bedway plate, the bedway plate being moveably inserted in the jaw bedway and also being moveably connected to the lower end of the shaft portion; and wherein the tool has a closed position and an opposite open position, and the second jaw member is engaged against the first jaw member when the tool is in the closed position, and disengaged from the first jaw member when the tool is in the open position.

BRIEF DESCRIPTION OF THE SEVERAL VIEWS OF THE DRAWINGS

A more complete understanding of the invention and its advantages will be apparent from the following detailed description taken in conjunction with the accompanying drawings, wherein examples of the invention are shown, and wherein:

FIG. 3 is a side elevational view of a segment of the trigger portion of the nail removal tool according to FIG. 1;

FIG. 4 is a side elevational view of a nail removal tool according to FIG. 1;

FIG. 5 is a rear elevational view of a nail removal tool according to FIG. 4, in an open position;

DETAILED DESCRIPTION OF THE INVENTION

Figure 1:
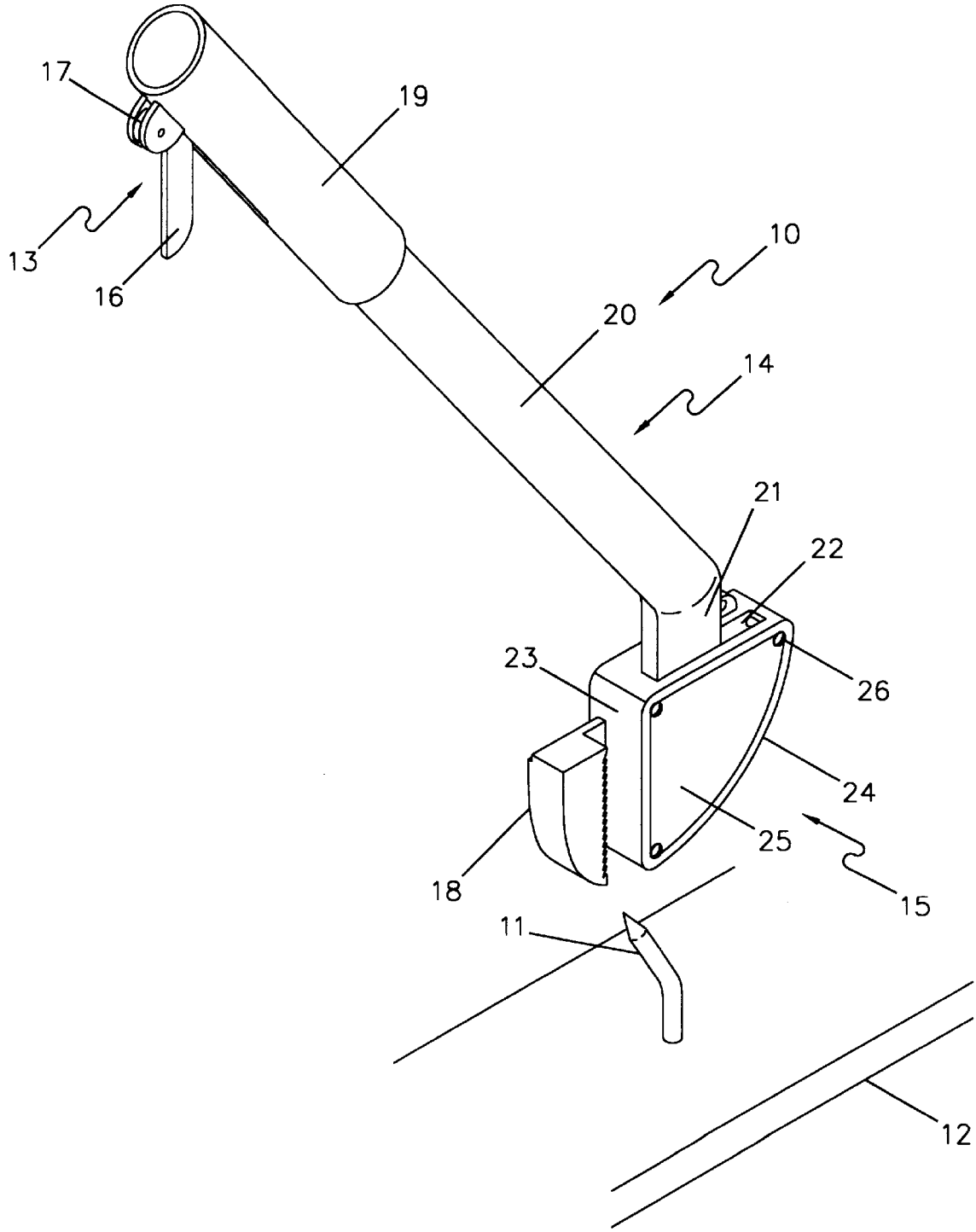
FIG. 1 shows a side perspective view of a nail removal tool according to the present invention, shown in an open position.

In the following description, like reference characters designate like or corresponding parts throughout the several views. Also, in the following description, it is to be understood that such terms as "front," "back," "right," "left," and the like are words of convenience and are not to be construed as limiting terms. Referring in more detail to the drawings, the invention will now be described.

Referring to FIG. 1, a nail removal tool constructed in accordance with the present invention is generally shown at 10. In FIG. 1, the tool 10 is positioned over a pointed nail shaft 11 which is partially embedded in a surface 12. The nail removal tool of the present invention is for pulling an elongated object, particularly a nail, which is embedded in a body having a surface, through the surface. A visible portion of the elongated object, such as the bottom part of a nail shaft (body), must extend beyond the surface in order for the tool to grasp it. The nail is shown here in the surface 12 of a board. The tool 10 is shown from the right (cover) side.

Generally, this nail removal tool 10 has an elongated upper body attached to a movable head portion. The head portion is at the lower end of the tool when it is held in an upright position ready for use. The tool 10 generally includes four parts: first, an optional trigger portion 13; second, a shaft portion 14; third, the movable head portion 15, which comprises a first jaw member; and fourth, a second jaw portion 18. Preferably, the trigger portion 13 includes a lever trigger 16, and a trigger joint 17, as shown in FIG. 1. The tool has an open position, shown in FIG. 1, and a closed position, when the jaws grip either side of the nail shaft 11. The tool is preferably substantially made of tool steel or any other suitable, sturdy material. Once a nail shaft is engaged by the jaws, the lever trigger mechanism is not needed any longer because the leverage exerted by the user on the handle segment increases closing pressure on the jaws. Thus, the more resistant the nail is to removal, the harder the tool's jaws squeeze the nail shaft.

The trigger portion comprises a trigger for opening or closing the jaw members, and a second pivot mechanism for causing the head portion to pivot in relation to the shaft portion. This is preferred because it allows one-handed operation by the user. The user holds the tool with his or her preferred hand around the handle segment. The user can depress the trigger lever using the forefinger of the hand. However, the tool can be operated without the trigger portion. It is believed that the tool is so effective because of the relationship of the handle, head and jaws to each other.

The tool of the present invention is particularly suitable for the removal of nails with heads which are less than about 5 millimeters in diameter. For example, a nail may have a broken-off, hemispherical head showing on one side of a baseboard, with a portion of the nail shaft and the point projecting from the opposite side of the baseboard. Rust or removal attempts with conventional tools often cause nail heads to break or shear off. The tool of the present invention can grasp and remove slender or thick nails with smooth or rough finishes. It can also be used on nails manufactured without heads. This tool is capable of pulling long or short, intact or broken-off nails, so long as some portion of the nail body is visible above the surface of the body.

This tool is preferably for use on finishing nails of any length or width, bent or straight, especially pneumatic finishing nails. Relatively new pneumatic finishing nails are particularly difficult to remove from surfaces because they have a very smooth finish and are so slender that they cannot easily be backed out without bending them. Efforts to pull them out of wooden surfaces using conventional tools often results in splintering of the surface or in the nails snapping off. The nail removal tool of the present invention grabs these pneumatic finishing nails and ordinarily pulls them cleanly through and out of the surface.

The nails to be removed may be embedded in wooden baseboards, moldings, shelving, paneling, hardwood floors, etc. The tool of the present invention is particularly useful for remodeling projects. Workmen who will be pulling apart wooden elements of a residence or business and then replacing them may also find this tool helpful. For example, exterminators and burglar alarm installers often must pull up baseboards, etc. to do their work. They can use this tool for removing nails prior to reattaching the baseboards and other surfaces. This tool is useful wherever the removal and collection of spent nails from wooden or wood-like surfaces is particularly important. It is particularly useful for remodeling projects in historic homes, where preservation of existing crown moldings, baseboards, etc. is of paramount importance.

The second part of the tool, the shaft portion 14, comprises a straight, cylindrical handle segment 20 at the upper end, and an angled, flattened end segment 21 at its lower end as shown in FIG. 1. The handle segment preferably includes a slightly enlarged, knurled handle grip 19 for comfortably grasping the tool for periods of time. The shaft portion 14 resembles a hockey stick. The end segment is bent and flattened so that it easily fits through a slot in the head portion 15. By "angled" is meant that, when the tool is upright and in use covering the nail, the handle segment 20 will be at approximately a 60 (between about 50 and 70) degree angle from the surface 12 of the board. This is advantageous because once the nail has been grasped in the jaw, the user can use a lever-like motion to easily pull the handle out and away from the nail (rocked back). Having a shaft portion 14 that is angled differently at the lower end (compared to the upper end) is advantageous because it prevents the user's hand or forearm from impacting the surface when the user pulls the handle down. If the shaft portion was entirely straight rather than angled, it is believed that the user's hand would be more likely to impact the surface when the handle is pulled downward. When the tool 10 is covering the protruding portion of the nail, the flattened lower end segment 21 of the handle portion is preferably approximately perpendicular to both the top side of the head portion 15 and the surface 12. By "covering the nail" is meant that the two jaw members are in place on either side of the nail shaft 11.

Figure 2:
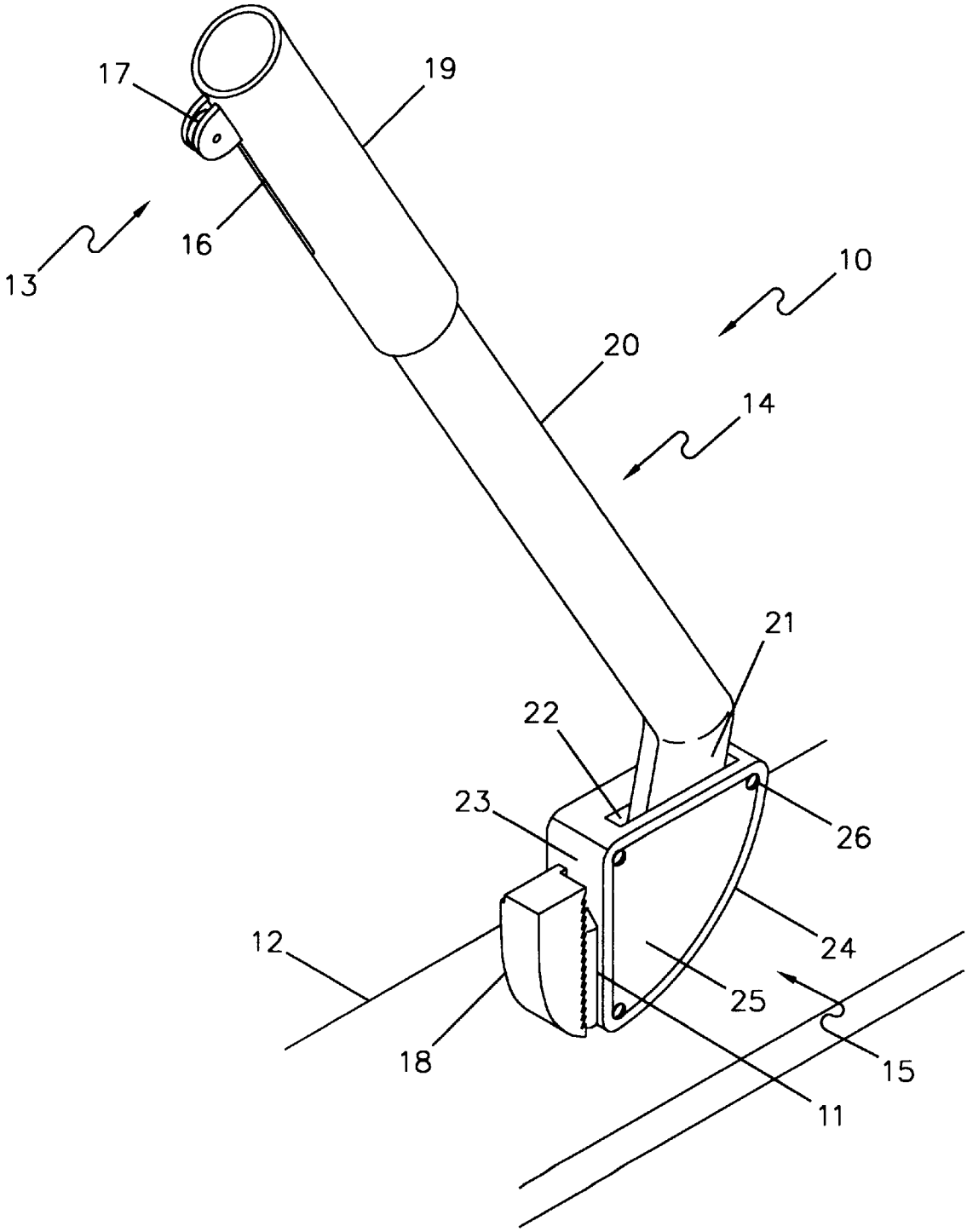
FIG. 2 is a side perspective view of a nail removal tool according to FIG. 1, shown in a closed position.

FIG. 2 shows the tool in a closed position, and FIG. 1 shows it in an open position. The head portion 15 of the tool 10 is slotted at the top for receiving the flattened end segment 21 of the shaft portion 14. The flattened end segment 21 is capable of moving back and forth in the head slot 22, which is shown in FIGS. 1 and 2. Preferably, the head portion 15 is generally in the shape of one quadrant of a circle. As shown in FIG. 2, a first, top, flat side comprises the head slot 22. A second side, which is also flat and adjacent to the first side, comprises the first jaw member 23. A third, bottom side, which is adjacent to the first and second sides and which contacts the body surface during use, comprises a curved heel 24 which is advantageous because the tool rocks back on it when the handle segment 20 is levered down after the jaws are closed on the nail shaft. The junction of the curved heel 24 with the first jaw member 23 is preferably slightly rounded to reduce the likelihood that the nail will be cut during extraction from the surface.

As shown in FIGS. 1 and 2, one side of the head portion 15 holds a head cover 25. The head cover 25 is preferably fastened to the head portion 15 by three cover screws 26 projecting through holes in the three corners of the head cover 25.

In FIG. 1, the upper handle segment 20 is at approximately a 60 degree angle from the surface 12, the lower end segment 21 is at the anterior end of the head slot 22, and the opposing jaw members are open. In FIG. 2, the trigger lever 16 has been depressed, the upper handle segment 20 is at a greater angle from the surface 12, the lower end segment 21 is at the posterior end of the head slot 22, and the jaw members are closed around the nail shaft 11.

Referring to FIG. 3, the trigger lever 16 is connected through a trigger joint 17 to a long, thin rod 27 (preferred) or cable (not shown) inside the hollow handle segment 20. In this preferred embodiment, the trigger portion 13 comprises a first rod, a spring mechanism 28, and a second rod connected in series, wherein the first rod is connected at one end via a joint to the trigger lever 16 and at an opposite end to the spring mechanism 28, and the second rod is connected at a first end to the spring mechanism and at an opposite end to an eye on the top side of the head portion. A spring in the spring mechanism 28 is at rest when the tool is in the open position (not in use). The purpose of the trigger portion is to initiate contact between the jaw members and the nail shaft, and, after extraction, to hold the nail until it can be deposited in a receptacle. Other mechanisms for opening or closing the jaw members, such as a push button at the top of the handle portion or a compressible foot projecting from the head portion, could also be satisfactorily employed in the present invention.

FIGS. 4 and 5 show a nail removal tool according to FIG. 1, shown from the side (FIG. 4) and the back (FIG. 5) of the tool 10. The tool 10 preferably comprises a trigger portion 13 for causing the jaw members to close on a nail shaft, which comprises: a trigger lever 16 at the upper end of the cylindrical handle segment 20, and a rod 27 or cable. The rod or cable is ordinarily enclosed within and runs the length of the cylindrical handle portion 20 and out an opening 29 in the bottom end of the handle segment. The rod or cable is moveably connected at an upper end to the trigger lever 16 and attached at an opposite, lower end of the rod or cable to the top side of the moveable head portion. As shown in FIG. 5, the rod 27 is attached through an eye 30 at the posterior end of the top of the movable head portion 15. When the trigger lever 16 is depressed, the rod 27 is pulled up within the upper handle segment 20, which puts tension on the spring 28, which pulls up on the eye 30, which rotates the head portion 15. The second jaw portion 18 includes a plate which is slidably affixed in a jaw bedway 31 along one side of the head portion 15, as shown from the back of the tool in FIG. 5. When the trigger lever 16 is depressed and the back of the head portion is pulled up, the front of the head portion goes down, and the second jaw portion 18 is pulled toward the opposing jaw member 23 on the head portion.

Figures 6, 7, 8, 9:
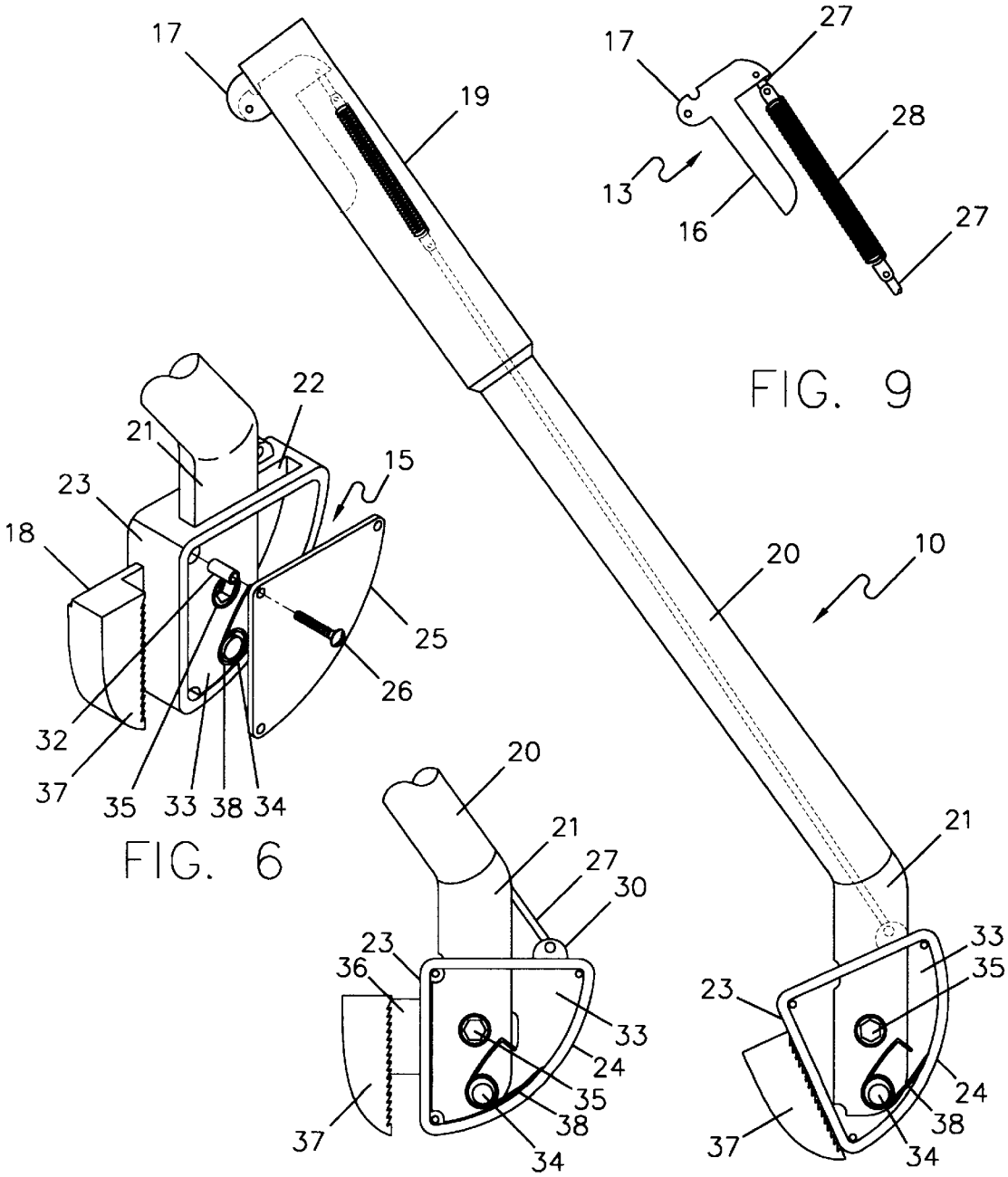
FIG. 6 is a side perspective view of a head portion of a nail removal tool according to the present invention, shown in an open position.
FIG. 7 is a side elevational view of the head portion according to FIG. 6, shown in an open position without a cover.
FIG. 8 is a side elevational view of the nail removal tool according to FIG. 2, shown in a closed position without a cover.
FIG. 9 is a side view of a segment of a trigger portion of the nail removal tool according to FIG. 8, in a closed position.

Referring to FIG. 6, on the opposite side of the head from the jaw bedway 31 is the head cover 25. The head cover is attached to the head portion 15 by screws 26, which are inserted through spacers 32. Under the head cover is an interior head compartment 33. The bottom of the flattened end segment 21 can be seen inside the head compartment 33.

The tools shown in FIGS. 6 and 7 are in the open position, while the tool in FIG. 8 is in the closed position. The flattened end segment 21 is adjacent to the back of the first jaw member 23 when the tool is in the open position (see FIGS. 6 and 7), and angled in the head compartment when the tool is in the closed position (see FIG. 8). The flattened end segment 21 has two notches on its anterior (forward) side to accommodate the screw holes for the head cover 25.

The flattened end segment 21 has two holes in it, one above the other. As shown in FIGS. 6–8 and 11, a pivot pin 34 is placed through a first hole 41 at its lower end, and into a third hole 42, or depression, in the back wall of the head compartment 33. This is the important pivot point. It allows the flattened end segment to pivot back and forth in the head portion 15.

The moveable connection between the bedway plate 36, the head portion 15, and the flattened end segment 21 is a screw 35 which fits through a second hole in the flattened end segment, through a slotted hole 39 in the back wall of the head portion, and into a threaded hole 40 in the bedway plate. As shown in FIGS. 6–8, a socket cap screw 35 extends through the more centrally located, larger diameter second hole in the flattened end segment 21. The socket cap screw 35 extends through the flattened end segment 21, through a slot in the back wall of the head compartment 33, and into a threaded hole 40 in the bedway plate 36. The bedway plate 36 slides back and forth in the jaw bedway 31. The slot in the back wall of the head compartment 33 is oblong so that the cap screw 35 extending from the flattened end segment 21 can move back and forth along the slot as the head portion 15 rotates when the trigger lever 16 is depressed. When the head portion 15 moves, the bedway plate 36 on the opposite side of the back wall (see FIG. 7) slides back in the jaw bedway 31. This brings the second jaw portion 18 toward the head portion, and into the closed position.

As shown in FIGS. 6–8, the pivot mechanism within the head compartment 33 further comprises a spring member 38. The pivot spring member 38 is preferably fastened around a top part of the pivot pin 34 and has two arms, one of which is positioned against the curved heel 24 of the head portion, and the other of which is positioned against the flattened end segment 21. One arm of the pivot spring member 38 ends at the curved heel 24 of the head portion 15, and the other arm of the spring member is against the flattened end segment 21. This pivot spring member 38 allows the head portion 15 to spring back into the open position once the nail has been pulled and the trigger lever 16 is released.

Referring to FIG. 9, the trigger lever 16 has been depressed into a slot in the handle grip 19. Within the upper handle segment 20, the rod 27 is drawn up, which pulls the spring mechanism 28 into a stretched position. The lower end of the rod 27 is in turn pulled up, which brings the posterior part of the head portion 15 up. This pulls the front of the head portion down, and pulls the second jaw portion 18 in toward the opposing, first jaw member 23. The tool 10 is now in the closed position.

Figure 10:
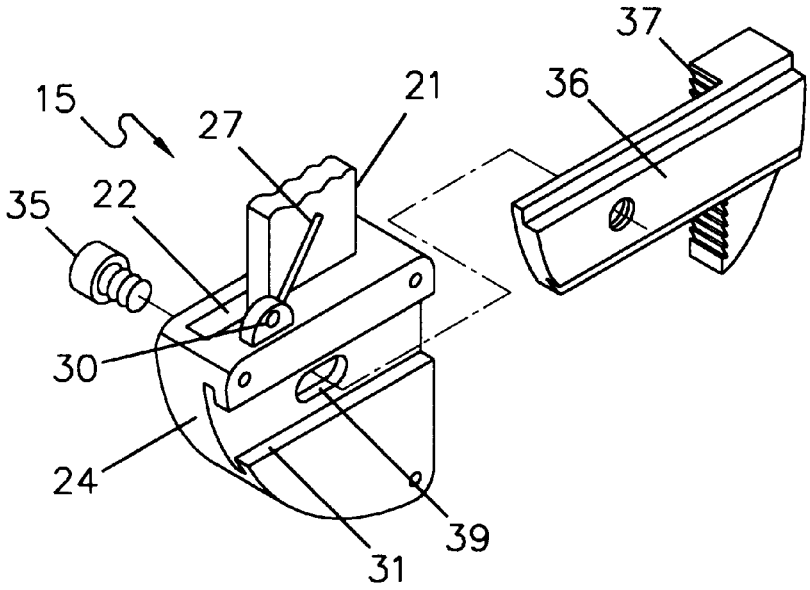
FIG. 10 is a side perspective view of a head portion of a nail removal tool according to the present invention, showing a jaw bedway.

FIG. 10 shows the placement of the socket cap screw 35 in an oblong slot 39 in the back wall of the head compartment 33. The socket cap screw 35, as shown in FIGS. 6–8, extends through the higher of the two holes in the flattened end segment 21. Next, the socket cap screw 35 passes through the oblong slot 39 and into a round, threaded hole 40 in the bedway plate 36. The second jaw portion 18 comprises a second jaw member 37 and the adjacent bedway plate 36. As the head rotates around the flattened end segment 21, the socket cap screw moves back or forward along the oblong slot 39. This movement slides the bedway plate 36 backward or forward in the jaw bedway 31 because the end of the socket cap screw 35 is fixed in the bedway plate 36. When the bedway plate 36 moves back along the jaw bedway 31, the second jaw member 37, which is attached to one end of the bedway plate 36, closes on the nail. When the bedway plate is moved forward along the jaw bedway, the second jaw member 37 moves away from the first jaw member 23, and the jaws open, releasing the nail. The movement of the socket cap screw 35 is controlled by the movement of the flattened end segment 21 in relation to the head portion 15. The first and second jaw members are preferably serrated to facilitate grasping of nail shafts.

Figure 11:
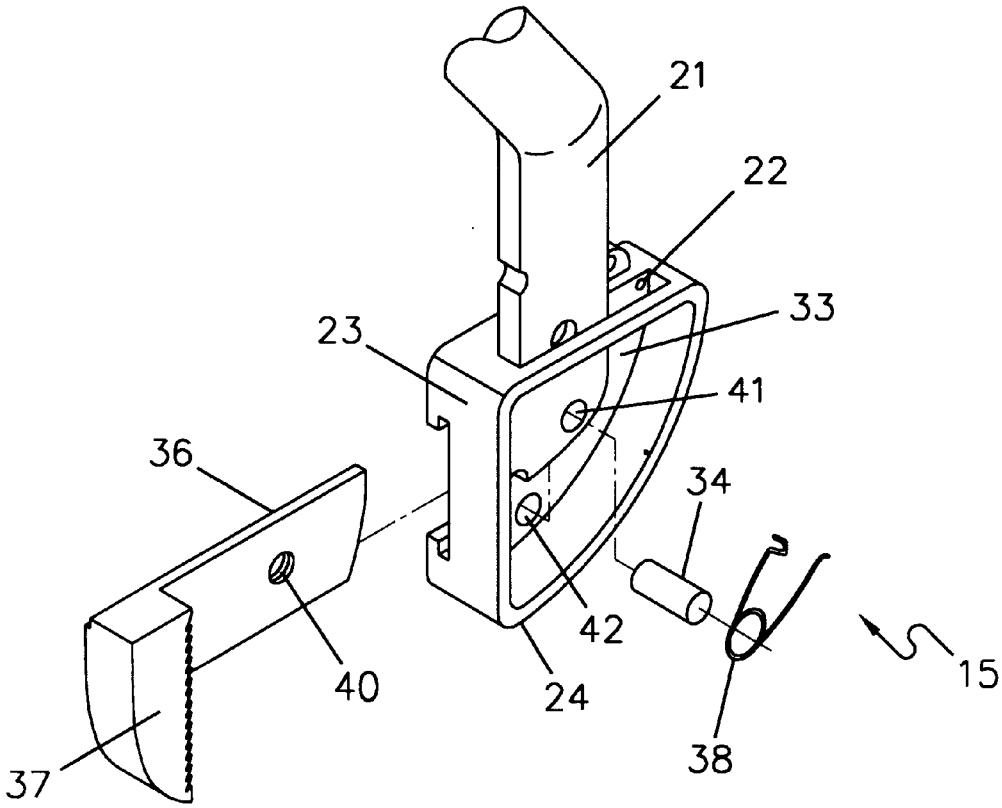
FIG. 11 is a side perspective view of the head portion according to FIG. 10, shown from the cover side of the head portion.

FIG. 11 shows the placement of the pivot pin 34 through the lower hole 41 in the lower end segment 21 and into the pivot hole 42 in the back wall of the head compartment 33. The lower end segment 21 is shown elevated in FIG. 11 so that the back wall of the head compartment 33 can be seen. Once the pivot pin 34 is in place, the pivot spring member 38 is placed over the protruding end of the pivot pin 34 in the head compartment 33. The head compartment is ordinarily covered by the head cover, which preferably keeps the handle pivot pin 34 from disengaging. For clarity, the jaw is shown removed in FIG. 11.

In use, the tool 10 is placed over the projecting portion of the nail shaft 11 with the second jaw member 37 on one side of the nail shaft 11 and the opposing jaw member 23 on the other side of the nail shaft 11. Once the tool is resting on the surface 12 of the board, the user depresses the lever trigger 16, causing the head portion 15 to pivot and the jaws to close on the nail shaft 11. The second jaw member 37 is engaged against the nail shaft 11, which is engaged against the opposing jaw member 23, when the tool 10 is in the closed position. The second jaw member 37 is disengaged from the opposing jaw member 23 when the tool is in the open position. Once nail extraction begins, the lever trigger mechanism is not needed as the force on the nail shaft increases the closing pressure on the jaws. Importantly, the more resistant the nail is to removal, the harder the jaws squeeze the nail shaft.

The length of the shaft portion 14 in relation to the size of the head portion 15, as well as the curve on the heel 24 of the head portion, present advantages in the present invention. The head portion is small relative to the long handle portion. The handle is long so that it acts as a lever that does not require much force in order to remove nails. The user thus does not become as tired from removing many nails during a work day. The curve of the heel 24 is slight and the head portion is relatively small compared to the long handle. The slight curve in the heel requires less force on the handle portion. In the most preferred embodiment, the length of the heel is approximately the length of a 3 inch long nail in a 1½ inch thick wooden board. This is one of the longest nail lengths currently available. Thus, when the shaft portion 14 is pulled down, the head portion 15 heels back only as much as is necessary to remove nails, and not more.

In the present tool, once the trigger lever 16 is depressed, the jaws are engaged and leverage takes over. This is unlike what occurs in a pair of pliers, for example. Here, the trigger mechanism is not what maintains the pressure on the nail shaft. The relationship of the handle, head and jaws in the present invention is designed to allow a minimum of force to be applied on the handle portion. The location of the pivot point is also important.

The tool of the present advantage is also uniquely advantageous in that it can help to remove embedded, elongated objects longer than a few inches by repeated, ratchet-like applications of the tool. In the case of a long, thin wire embedded in a piece of wood, for example, the user would repeatedly close the jaws on the wire, lever the handle segment, which would pull out a segment of the wire, release the wire and place the tool further down toward the surface, and repeat until the wire is completely removed.

A preferred embodiment of the present tool 10 has the following measurements. The slot between the jaw members 23, 37 is about 7 millimeters wide. Each jaw member is between about 3 and 4 centimeters in length, and about 1 and 2 centimeters in width. Each of the three sides of the head portion 15 is between about 5 and 7 centimeters in length, and about 2–3 centimeters in width. The bedway plate 36 is about 2½ inches in length, and between about ½ and ¾ inches wide. The upper handle segment 20 is about one foot in length, and the flattened end segment 21 is about 2–3 inches in length, and about 1 inch wide. There is about ½ inch between the pivot pin 34 and the socket cap screw 35 in the flattened end segment 21. The trigger lever 16 is about 2–3 inches long, and about ¼ inch wide.

This invention is a tool for removing nails from surfaces, such as moldings, baseboards, and shelves, without unduly damaging the surface. This tool is useful for long or short, slender or thick, bent or straight nails with a portion protruding from the surface. With the present device, the worker's initial attempts at nail removal are successful a very high percentage of the time. It is believed that this is more true of the present tool than of other currently available devices.

Even after the nail is pulled, this tool 10 continues to hold the nail until it can be deposited in a trash receptacle by releasing the trigger lever 16. This keeps job sites cleaner and safer.

The jaws remain parallel to each other, which allows this tool to grasp long or very short nail shafts protruding from the surface. With the parallel jaws, a maximal amount of gripping surface is available for contact with the nail shaft projecting from the surface, regardless of the length or shape of the nail shaft. The jaws can be placed against the surface because of their shape and conformation, which allows even short nail stubs to be grasped. There is also a generous space between the jaws when the tool is in the open position. This is advantageous because the nail shaft can be bent or otherwise misshapen, and the jaws will still cover it and close on it. The jaws are placed on either side of the nail and the bedway plate forms a third side between the jaw surfaces. This frames the nail, allowing the user to more quickly and easily align the nail within the jaws. With the present invention, the nail does not have to first be inserted through a hole in the tool, which would consume additional time and would exclude bent nails.

Also included within the present invention is a method for pulling a finishing or pneumatic nail through a body made of wood or a wood substitute and having a surface, the method including the steps of:

a) engaging a portion of the nail shaft by a tool;

b) operating the tool such that the tool exerts twisting and pulling forces on the nail shaft in a direction at an acute angle to the body surface, and pulls the nail through the wooden surface; and c) moving the tool away from the wooden surface, and disengaging the nail from the tool.

From the foregoing it can be realized that the described tool of the present invention may be easily and conveniently utilized for pulling nails. While preferred embodiments of the invention have been described using specific terms, this description is for illustrative purposes only. It will be apparent to those of ordinary skill in the art that various modifications may be made without departing from the spirit or scope of the invention, and that such modifications are intended to be within the scope of the present invention.

BRIEF LIST OF REFERENCE NUMBERS USED IN THE DRAWINGS

| | |
|---|---|
| 10 | nail removal tool |
| 11 | nail shaft |
| 12 | body surface |
| 13 | trigger portion |
| 14 | shaft portion |
| 15 | head portion |
| 16 | trigger lever |
| 17 | trigger joint |
| 18 | second jaw portion |
| 19 | handle grip |
| 20 | handle segment |
| 21 | flattened end segment |
| 22 | head slot |
| 23 | first jaw member |
| 24 | curved heel |
| 25 | head cover |
| 26 | cover screws |
| 27 | rod in trigger portion |
| 28 | spring mechanism |
| 29 | handle segment opening |
| 30 | eye on head portion |
| 31 | jaw bedway |
| 32 | compartment spacer |
| 33 | head compartment |
| 34 | handle pivot pin |
| 35 | socket cap screw |
| 36 | bedway plate |
| 37 | second jaw member |
| 38 | pivot spring member |
| 39 | oblong slot |
| 40 | round hole in bedway plate |
| 41 | first hole in flattened end segment |
| 42 | third hole in back wall |

What is claimed is:

1. A nail removal tool for pulling an elongated object through a surface, the nail removal tool comprising:

a) an elongated shaft portion having a handle portion at an upper end and a pivot mechanism at a lower end of the shaft portion;

b) a movable head portion moveably connected through the pivot mechanism to the lower end of the shaft portion, the head portion comprising a first jaw member, which is fixed to the head portion, and a jaw bedway for a second jaw member; and c) a second jaw member parallel to the first jaw member and attached to a movable bedway plate, the bedway plate being moveably inserted in the jaw bedway and also being moveably connected to the lower end of the shaft portion; and wherein the tool has a closed position and an opposite open position, and the second jaw member is engaged against the first jaw member when the tool is in the closed position, and disengaged from the first jaw member when the tool is in the open position; and wherein the shaft portion comprises a straight, cylindrical handle portion at the upper end, and an angled, flattened end segment at its lower end.

2. A nail removal tool according to claim 1, wherein the head portion further comprises a central, interior compartment for receiving the flattened end segment; and the head slot is of a size sufficient to accommodate forward and backward motion of the flattened end segment.

3. A nail removal tool according to claim 2, wherein the head portion is generally in the shape of a quadrant of a circle, with a first, top, flat side comprising a slot for receiving the flattened end segment; a second side, which is also flat and adjacent to the first side, comprising the first jaw member; and a third, bottom side, which is adjacent to the first and second sides and which contacts the body surface, comprising a curved heel for the tool to rock back on when the handle portion is levered down by the user.

4. A nail removal tool according to claim 3 for one handed operation by the user, further comprising:

d) a trigger portion comprising a trigger and a second pivot mechanism for causing the head portion to pivot in relation to the shaft portion.

5. A nail removal tool according to claim 3, wherein, within the compartment, the flattened end segment comprises a first hole at its lower end, and wherein the pivot mechanism comprises a pivot pin which passes through the first hole and into a third hole in a back wall of the head portion.

6. A nail removal tool according to claim 5, wherein the flattened end segment further comprises a second hole above the first hole, and wherein the moveable connection between the bedway plate, the head portion, and the lower end of the shaft portion is a screw which fits through the second hole in the flattened end segment, through a slotted hole in the back wall of the head portion, and into a threaded hole in the bedway plate.

7. A nail removal tool according to claim 6 for one-handed use on pneumatic or finish nails, further comprising a trigger portion for causing the jaw members to close on a nail shaft; the trigger portion comprising a trigger lever at the upper end of the cylindrical handle portion, and a rod or cable; the rod or cable being enclosed within and running the length of the cylindrical handle portion and out an opening in the cylindrical handle portion; the rod or cable being moveably connected at an upper end to the trigger lever and attached at an opposite, lower end of the rod or cable to the top side of the moveable head portion.

8. A nail removal tool according to claim 7, wherein the pivot mechanism within the compartment further comprises a spring member for causing the head portion to spring back into the open position once the nail has been pulled.

9. A nail removal tool according to claim 8, wherein the first and second jaw members have serrated edges facing each other to facilitate grasping of the nail shaft.

10. A nail removal tool according to claim 9, wherein the pivot spring member is fastened around a top part of the pivot pin and has two arms, one of which is positioned against the curved heel of the head portion, and the other of which is positioned against the flattened end segment.

11. A nail removal tool according to claim 10, wherein the trigger portion comprises a first rod, a spring mechanism, and a second rod connected in series, wherein the first rod is connected at one end via a joint to the trigger lever and at an opposite end to the spring mechanism, and the second rod is connected at a first end to the spring mechanism and at an opposite end to an eye on the top side of the head portion.

12. A nail removal tool according to claim 11, further comprising a thickened handle grip around an upper portion of the handle portion, the handle grip comprising a slot for receiving the trigger lever, and a trigger joint being affixed to the handle grip above the trigger slot.

* * * * *